US010427830B2

(12) United States Patent
McDade

(10) Patent No.: US 10,427,830 B2
(45) Date of Patent: Oct. 1, 2019

(54) ROTATING SIDEWALL STOP FOR SUPPORTING FOLDING SIDEWALLS OF A HEIGHT-EXTENDED BULK BOX

(71) Applicant: Schaefer Systems International, Inc., Charlotte, NC (US)

(72) Inventor: Clinton Lawrence McDade, Charlotte, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 225 days.

(21) Appl. No.: 15/678,561

(22) Filed: Aug. 16, 2017

(65) Prior Publication Data

US 2018/0093794 A1 Apr. 5, 2018

Related U.S. Application Data

(60) Provisional application No. 62/403,357, filed on Oct. 3, 2016.

(51) Int. Cl.
*B65D 21/02* (2006.01)
*B65D 6/18* (2006.01)
*B65D 21/08* (2006.01)

(52) U.S. Cl.
CPC ..... *B65D 11/1806* (2013.01); *B65D 11/1833* (2013.01); *B65D 21/086* (2013.01)

(58) Field of Classification Search
CPC ... B65D 7/24; B65D 7/26; B65D 9/12; B65D 9/14; B65D 11/1806; B65D 11/1833; B65D 11/18; B65D 21/086; B65D 2519/009; B65D 2519/00502; B65D 1/225
USPC ..... 220/6, 9.2, 9.3, 666; 206/577, 600; 190/10, 29–32
See application file for complete search history.

(56) References Cited

U.S. PATENT DOCUMENTS 1,223,253 A * 4/1917 Britton ..... B65D 9/14 217/15
1,286,828 A * 12/1918 Straley ..... B65D 7/26 220/6
4,573,577 A * 3/1986 Miller ..... B65D 21/062 206/506
4,662,532 A * 5/1987 Anderson ..... B65D 19/12 220/1.5

(Continued)

FOREIGN PATENT DOCUMENTS

EP 2228313 A1 9/2010

*Primary Examiner* — Andrew T Kirsch
*Assistant Examiner* — Elizabeth J Volz
(74) *Attorney, Agent, or Firm* — Shumaker, Loop & Kendrick, LLP

(57) ABSTRACT

A height-extended bulk box that includes a base having four sides, four height-extending walls connected to respective sides of the base and four sidewalls pivotally mounted to respective ones of the height-extending walls and movable between a vertically erected use position and a collapsed configuration wherein the sidewalls are rotated inwardly into the area defined by a quadrilinear base. At least one sidewall stop is positioned on one of the height-extending walls and is movable between a non-use stowed position and a deployed position that extends into the volume of the bulk box and arrests movement of a first of the sidewalls to be moved into a collapsed position past a position substantially parallel to the top deck of the base.

13 Claims, 8 Drawing Sheets

(56) References Cited

U.S. PATENT DOCUMENTS

| | | | | |
|---|---|---|---|---|
| 4,674,647 | A * | 6/1987 | Gyenge | B65D 19/18 220/1.5 |
| 6,820,761 | B1 * | 11/2004 | Mouri | B65D 11/1833 206/600 |
| 7,059,489 | B2 * | 6/2006 | Apps | B65D 11/1833 220/6 |
| 2006/0231449 | A1 * | 10/2006 | Hassell | B65D 21/062 206/506 |
| 2011/0259884 | A1 * | 10/2011 | Kellerer | B65D 11/1833 220/6 |

* cited by examiner

ROTATING SIDEWALL STOP FOR SUPPORTING FOLDING SIDEWALLS OF A HEIGHT-EXTENDED BULK BOX

CROSS-REFERENCE TO RELATED APPLICATION AND PRIORITY

This application claims priority from U.S. Provisional Patent Application No. 62/403,357, filed Oct. 3, 2016, the subject matter of which is incorporated herein by reference in its entirety.

TECHNICAL FIELD AND BACKGROUND OF THE INVENTION

This invention relates to bulk boxes, and more specifically to a rotating sidewall stop adapted for supporting the folding sidewalls of a height-extended bulk box.

In general, bulk boxes are designed to function as a container in a wide variety of uses, including in manufacturing, assembly, shipping and storage applications, and have foldable sidewalls that permit such bulk boxes to be collapsed by folding down the sidewalls. This substantially reduces the volume occupied by empty boxes and greatly increases the number of empty boxes that can be shipped or stored in a defined space. This ability increases the value of the boxes by permitting them to be shipped in an empty, collapsed condition at substantially less cost back to a facility where the sidewalls are again raised into a locked, upright position and then refilled with contents to be shipped for use elsewhere.

Conventional bulk boxes include a base and four folding sidewalls attached to the base and movable between vertically upright and collapsed conditions. The base includes two opposing base walls that have a predetermined short height with the other set of opposing base walls being taller. On the top rim of the base walls are pivot-mounting elements that accept pivot elements on the bottom of the sidewalls, which both fix the sidewalls to the base walls and allow the sidewalls to rotate relative to the base walls between vertically upright and collapsed positions. The pair of sidewalls connected to the short base walls are of equivalent height to one another but are taller than those of the pair of sidewalls connected to the taller base walls, which are of equivalent height to one another. This difference in heights is established so that the top rims of the taller sidewalls and the top rims of the shorter sidewalls are at the same height when the box is erected and create a flat plane for stacking.

One pair of sidewalls is folded down first and then the other pair. The bulk boxes are usually designed so that the individual sidewalls of each pair can be folded down in a non-sequential order for the convenience of the user. Whichever of the two sidewalls is folded down first, usually folds down until it rests on the top deck of the base. The top deck of the base provides a stop to the rotation of the sidewall as well as structural support. The second sidewall of the pair is then folded down to set on top of the first sidewall. In a bulk box without a height-extended base, the base itself supports each of the four of the sidewalls, as they are sequentially rotated 90 or 90+ degrees from the upright position into the collapsed position against the base.

Some bulk boxes have bases with height-extending walls that extend upwardly from the base and to the tops of which the respective sidewalls are rotatably attached. Thus, in the height-extended bulk boxes, there are three sets of walls—four base walls, four upward-extending, height-extending walls and four pivoting sidewalls.

In such a height-extended bulk box, the four height-extending walls are attached to the base in a fixed, non-pivoting manner. The top architecture of these height-extending walls match the architecture of the base walls in that the top sidewall, pivot-mounting provisions are identical to those of the base walls and the height difference between the pairs of base walls are duplicated in the tops of the height-extending walls. This is done so that the folding sidewalls can attach to the tops of the height-extending walls in the identical fashion as they do on the base walls and so the sidewalls can also pivot and fold down in the same fashion on the height-extending walls as they do on the base walls.

However, there is a required difference in function dictated by this height-extended arrangement, because the sidewall pivots are now elevated to the height of the top edge of the height-extending walls. Whichever of the two sidewalls is folded down first cannot reach and thus be supported by the top deck of the base. Therefore, there is nothing to stop its rotation and nothing to provide structural support to it above the level of the base. It is possible that in height-extended bulk boxes, the rotation of this first folding wall will continue unimpeded and may pull the sidewall pivots out of the mounting provisions in the top of the height-extending walls or cause damage to the sidewall pivots. Some prior art sidewall stops are fixed in position on the height-extending walls and cannot be removed when not in use. This impinges on the usable internal volume of the erected, height-extended bulk box. Preventing the over-rotation of the sidewalls while avoiding the disadvantages of the prior art is a purpose of this invention.

SUMMARY OF THE INVENTION

Therefore, it is an object of the invention to provide a bulk box with height-extending walls that includes a device for arresting the sidewalls in a correct, non-over-rotated position in the box when the sidewalls are collapsed.

It is another object of the invention to provide a bulk box with height-extending walls that includes a sidewall stop that is positioned on at least one of the height-extending walls of a bulk box and is movable between a deployed, sidewall-supporting position and a retracted non-use position.

It is another object of the invention to provide a bulk box with height-extending walls that includes a sidewall stop that is positioned on the height-extending wall of a bulk box and is rotatable between a deployed, sidewall-supporting position and a stowed, non-use position.

According to another embodiment of the invention, the sidewall stop is mounted for rotation between the stowed position and the deployed position.

According to another embodiment of the invention, first and second sidewall stops are positioned on first and second opposing height-extending walls.

According to another embodiment of the invention, the opposed height-extending walls include respective pockets, the first and second sidewall stops are positioned in respective ones of the pockets and are mounted for rotation between a stowed position with the sidewall stops positioned in the respective pockets, and a deployed position with the respective sidewall stops extending into the volume of the bulk box to support.

According to another embodiment of the invention, the quadrilateral sides of the base are of equal length.

According to another embodiment of the invention, a height-extended bulk box is provided that includes a quadrilateral base, four height-extending walls connected to respective sides of the base and four sidewalls pivotally mounted to respective ones of the height-extending walls and rotatable between a vertically erected use position and a collapsed configuration wherein the sidewalls are rotated inwardly into the area defined by a quadrilateral base. At least one sidewall stop is positioned on one of the height-extending walls and is movable between a non-use stowed position, and a deployed position that extends into the volume of the bulk box and arrests movement of a first of the sidewalls to be moved into a collapsed position past a position substantially parallel to the top deck of the base. The sidewall stop includes a top wall support surface parallel to the top deck of the base and a cantilever member positioned to maintain the sidewall stop parallel to the top deck of the base.

According to another embodiment of the invention, the pocket includes a top wall, a bottom wall, and a top post of the sidewall stop positioned for rotation in a slot in the top wall of the pocket and a bushing positioned on the sidewall stop for rotation on a bottom mounting post positioned on the bottom wall of the pocket.

According to another embodiment of the invention, an indexing tab is formed in and extends upwardly from a base of the bottom mounting post and is adapted to be received in a first slot in the bushing when the sidewall stop is in the stowed position and in a second, spaced-apart slot in the bushing when the sidewall stop is in the deployed position.

According to another embodiment of the invention, the first and second slots are spaced 90 degrees apart.

According to another embodiment of the invention, the sidewall stop includes a top wall support surface parallel to the top deck of the base and a cantilever member positioned to maintain the sidewall stop parallel to the top deck of the base.

According to another embodiment of the invention, the top wall support and the cantilever member of the sidewall stop are integrally formed.

According to another embodiment of the invention, first and second sidewall stops are positioned on first and second opposing height-extending walls and are movable between a non-use stowed position and a deployed position that extends into the volume of the bulk box.

According to another embodiment of the invention, the four sidewalls are pivotally mounted to respective ones of the height-extending walls by hinges that each includes an elongate hinge pocket having a vertical dimension formed in a top edge of one of the height-extending walls. A bottom edge of the sidewall includes a correspondingly-spaced hinge lug for being received into the hinge pocket for pivoting movement with movement of the sidewall, the hinge lug adapted to move vertically up and down within the hinge pocket as the sidewall is moved between upright and collapsed positions to permit the height-extending wall to achieve a coplanar position relative to the base in the collapsed condition.

BRIEF DESCRIPTION OF THE DRAWINGS

The embodiment of the invention is further explained with reference to the drawings, in which.

DETAILED DESCRIPTION OF THE PREFERRED EMBODIMENT

Figure 1:
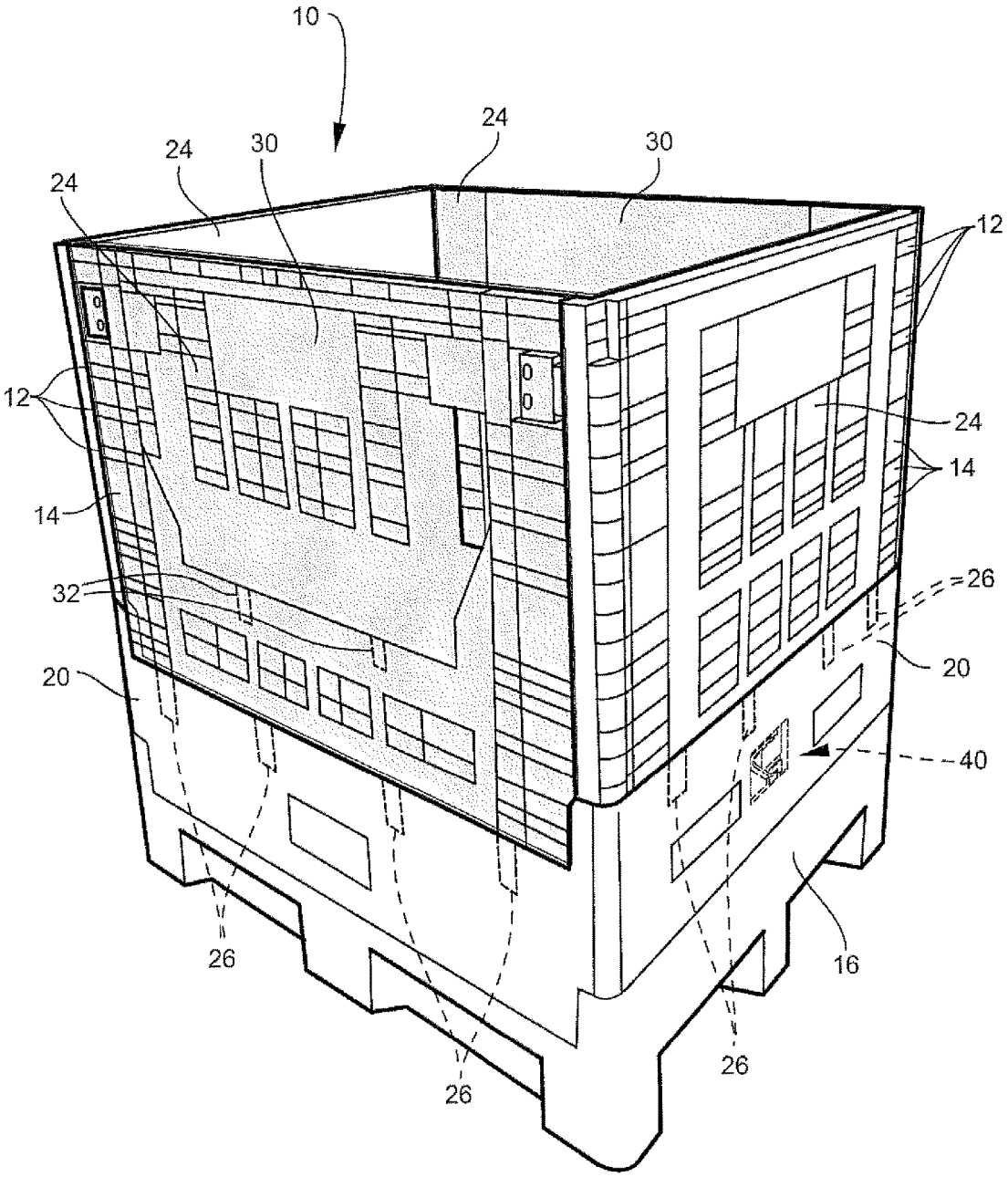
FIG. 1 is a perspective view of a bulk box with height extenders according to one preferred embodiment of the invention in its fully erected condition.

Referring now to the drawings, a fully erected, use position of a bulk box according to one preferred embodiment of the invention is shown in FIG. 1 at reference numeral 10. The bulk box 10 is fabricated of suitable high-density plastic material and is formed with a multitude of spaced-apart and intersecting ribs 12 that define recesses 14 that provide strength and reduce weight. The bulk box 10 includes a base 16, height-extending walls 20 (two of four shown) that extend upwardly above the base 16 and to the tops of which respective sidewalls 24 are rotatably attached by floating hinges 26, described in more detail below. In FIG. 1, the sidewalls 24 are shown in their vertically erected use position. In the particular embodiment shown in the Figures, access doors 30 are mounted by hinges 32 for allowing access into and out of the interior of the bulk box 10 from a lower height above the base 16. When in use, the sidewalls 24 are as shown in FIG. 1. While sizes vary, a typical bulk box may be 4 ft. wide, 4 ft. deep and 3 ft. high (39 cm×39 cm×39 cm) and the sidewalls 24 are greater than one-half of the total height of the bulk box 10.

As noted above, the sidewalls 24 are a substantial height above the base 16. When folded inwardly without some interior support, the first of the sidewalls 24 will fold down to the base 16 at an oblique angle without support and is subject to damage. The second sidewall 24 to be folded will bear against the first sidewall creating the further possibility of damage. In one preferred embodiment, the third wall will fold down and be supported on its side edges by the top rim 59 of the first and second sidewalls 24. The fourth sidewall 24 will fold down and rest on the collapsed third sidewall 24.

Thus, when the first and second sidewalls 24 are rotated into a collapsed position, there should be some structure that stops the sidewalls 24 from rotating past 90 degrees and into the volume defined by the height-extending walls 20.

Figure 2:
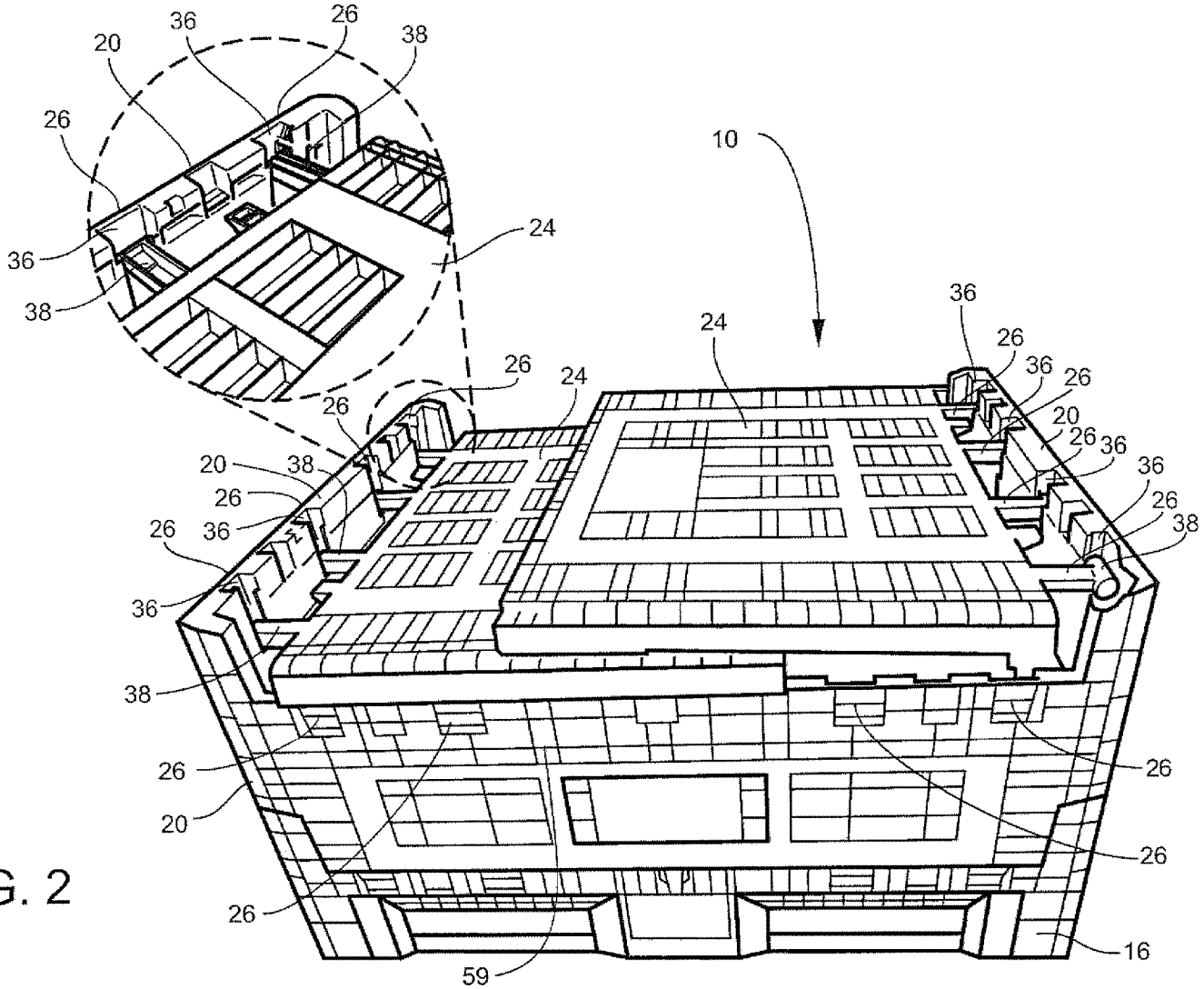
FIG. 2 is a perspective view of the bulk box with height extenders of FIG. 1 with the sidewalls in a collapsed condition.

Referring now to FIG. 2, the bulk box 10 is shown in a collapsed condition with the four sidewalls 24 resting in substantially parallel relation to the top deck of the base 16. The sidewalls 24 rotate on the hinges 26, as noted above. The hinges 26 each include an elongate hinge pocket 36 formed in a top edge of the side extending walls 20. The bottom edge of the sidewalls 24 includes correspondingly-spaced, integrally-molded, T-shaped hinge lugs 38 that fit into the hinge pockets 36. The hinge pockets 36 are substantially deeper than the vertical extent of the hinge lugs 38 so that the hinge lugs 38 are permitted to "float" up and down within the hinge pockets 36 as the sidewalls 24 are moved between the upright and collapsed positions. As shown in FIG. 2, the hinge lugs 38 on the left-hand sidewall 24 are positioned at a lower position in the hinge pockets 36 than the hinge lugs 38 on the right-hand sidewall 24. The right-hand sidewall 24 is thereby allowed to pivot into a suitable collapsed position by means of the hinge lugs 38 riding up and down in the hinge pockets 36, as necessary.

Figure 3:
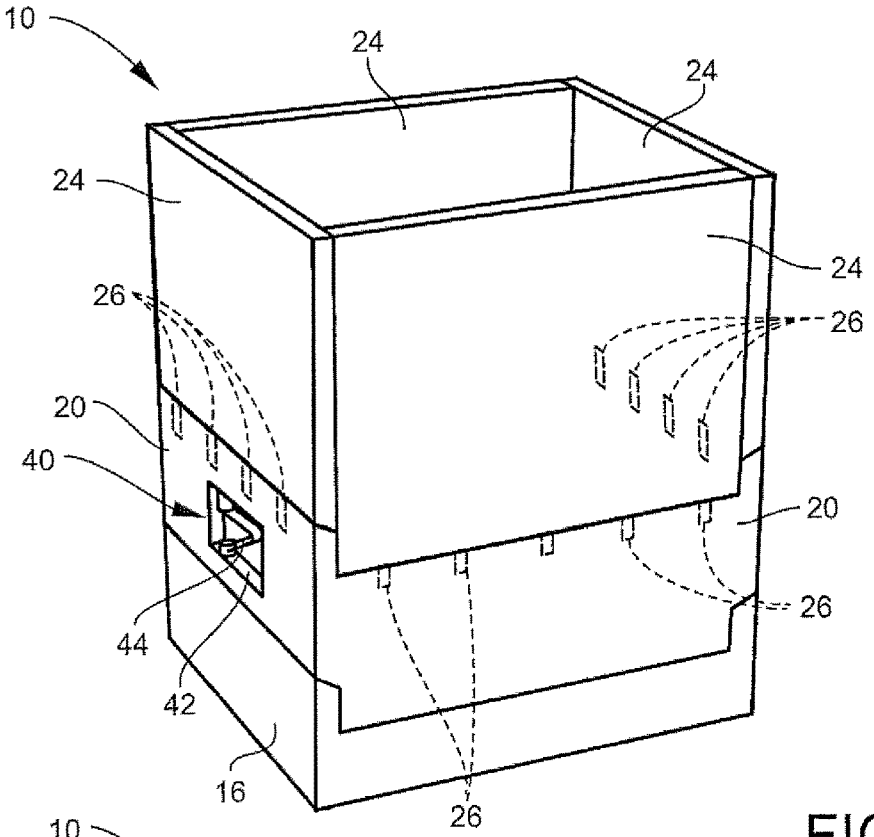
FIGS. 3-10 are simplified views of the bulk box of FIGS. 1 and 2, showing progressive steps of transforming the box from a fully-erected condition to a collapsed condition.
Figure 4:
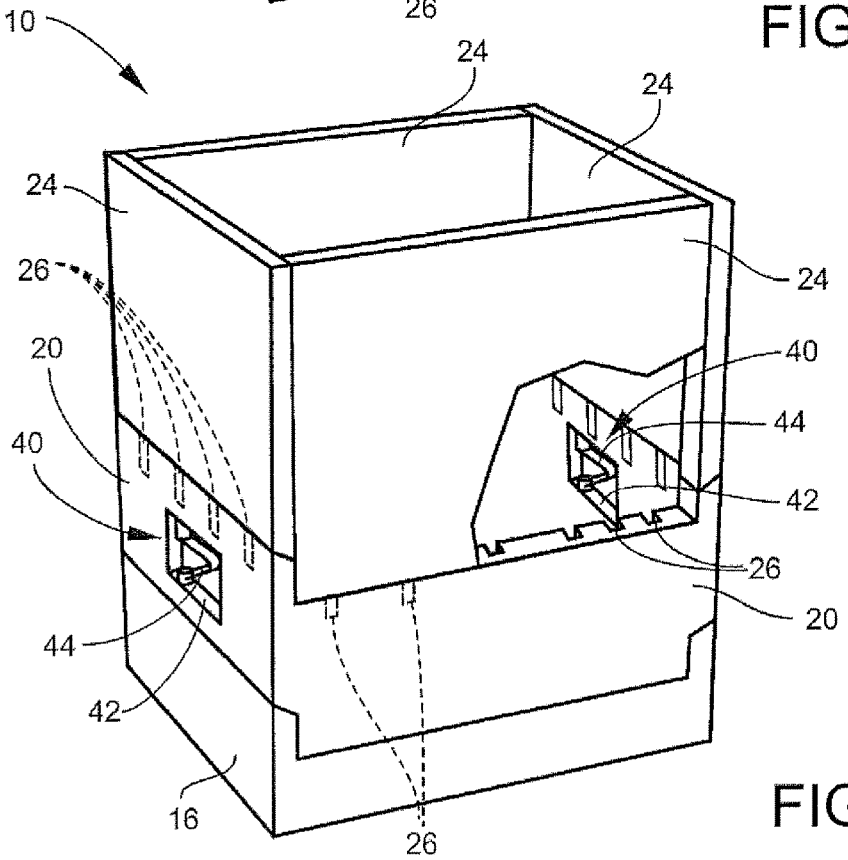

Support for the sidewalls 24 is provided by sidewall stop assemblies 40 positioned in two opposing height-extending walls 20, as shown in simplified form in FIGS. 1 and 3-10. Referring to FIGS. 3 and 4, the sidewall stop assemblies 40 each include a pocket 42 in which is pivotally-mounted a sidewall stop 44. The sidewall stops 44 are shown in the stowed position within the respective pockets 42. In this position, the sidewall stops 44 do not extend into the interior of the bulk box 10 and therefore do not interfere with the placement or the volume of contents in the bulk box 10.

The sidewall stops 44 include a top wall support surface 44A as shown in FIGS. 11-14 that is parallel to the top deck of the base 16 and a cantilever member 4413 as show shown in FIGS. 11-14 that is positioned to support the sidewall stop 44 in a position parallel to the top deck of the base 16.

Figure 5:
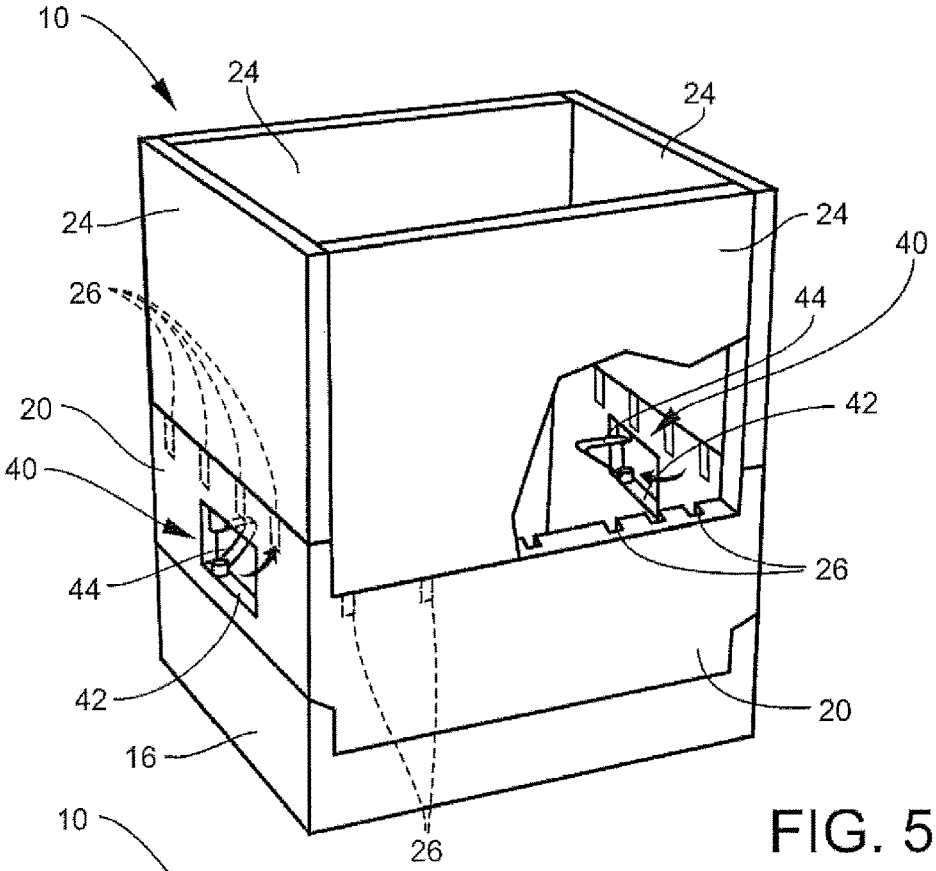
Figure 6:
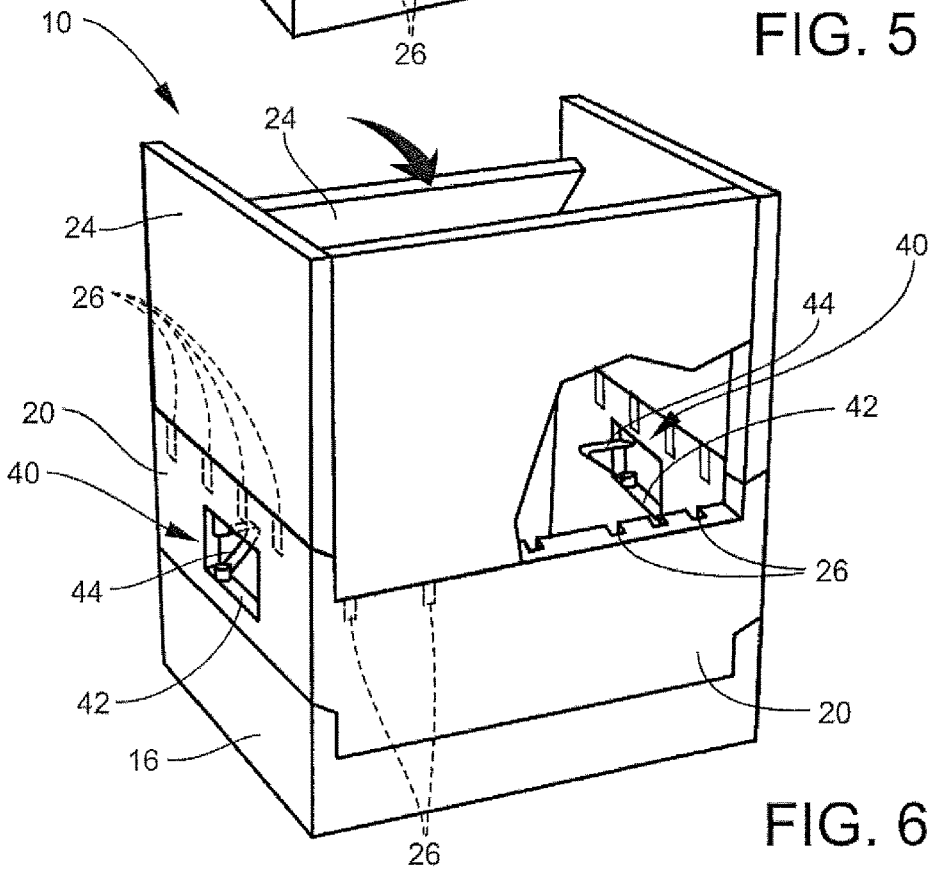
Figure 7:
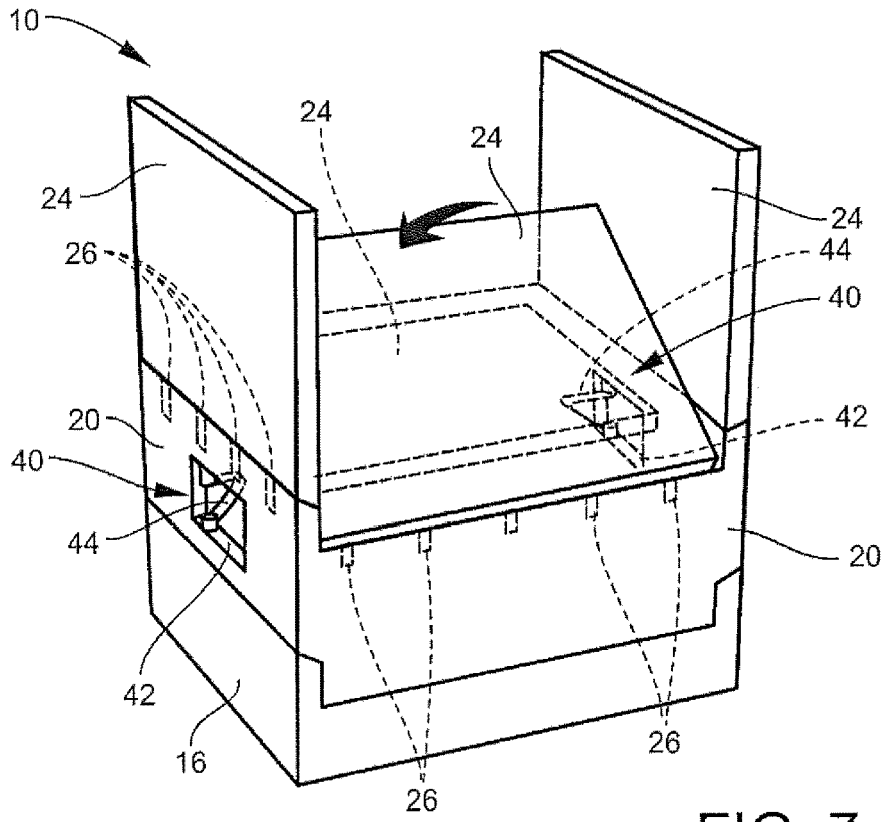
Figure 8:
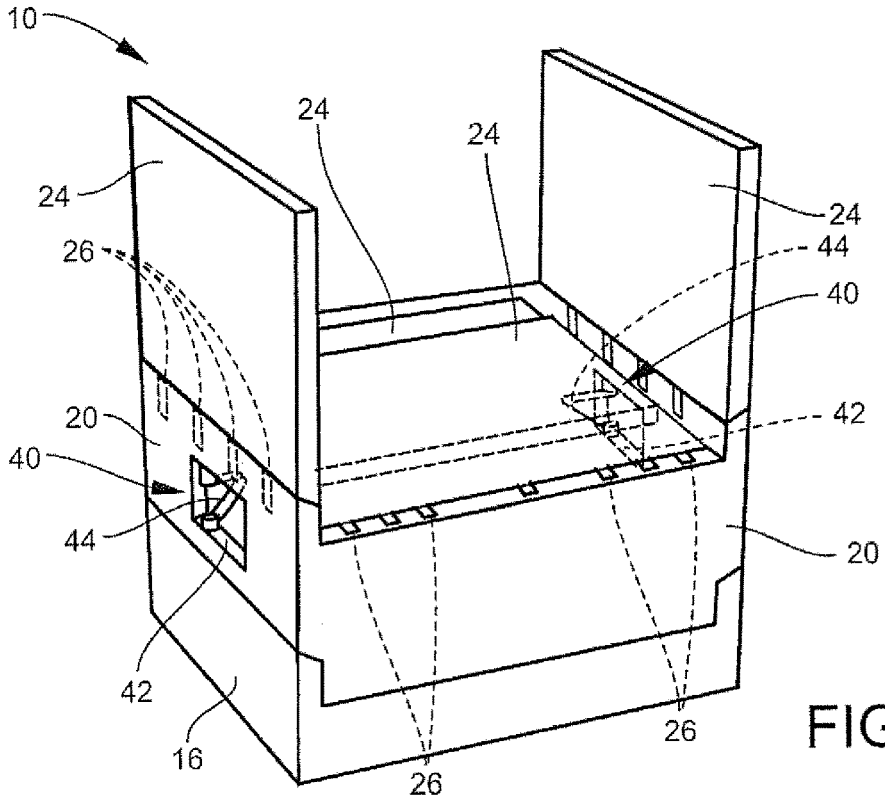

As shown in FIG. 5, to deploy the opposing sidewall stops 44, they are rotated 90 or 90+ degrees into a deployed position where they extend into the interior of the bulk box 10 at a height below the top edge of the height-extending walls 20 in which they reside. When deployed, a first adjacent sidewall 24 is rotated into its collapsed position, as is shown taking place in FIG. 6. When the sidewall reaches its collapsed position resting on the sidewall stops 44, its downward movement is arrested at a position essentially parallel to the top deck of the base 16. Then, as shown in FIG. 7, the opposing adjacent sidewall 24 is rotated into its collapsed position on top of and supported by the first collapsed sidewall 24, assuming the positions shown in FIG. 8.

Figure 9:
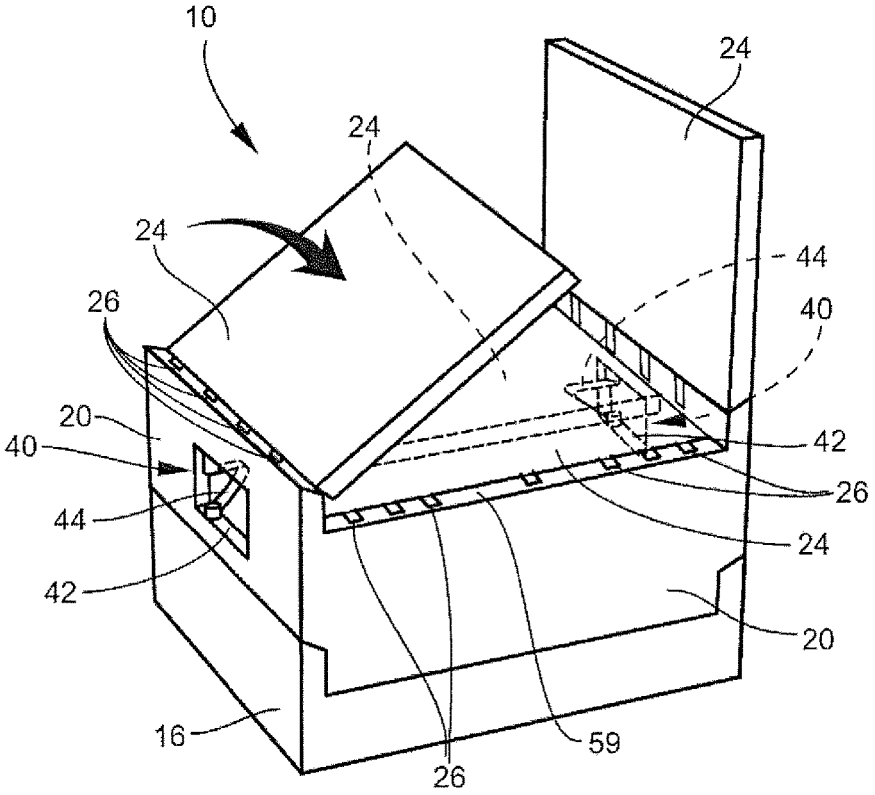
Figure 10:
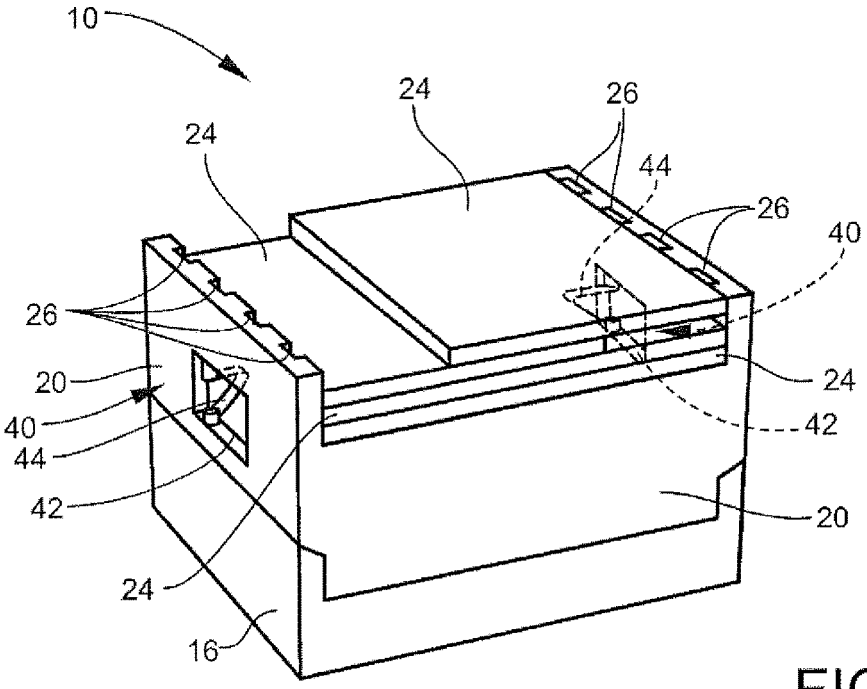

As shown in FIGS. 9 and 10, the remaining two sidewalls 24 are rotated into their respective collapsed position and assume the position shown in FIG. 10. Note that due to the floating hinges 26, each of the sidewalls 24 are permitted to reside in a parallel position in relation to top deck of the base 16.

Figure 11:
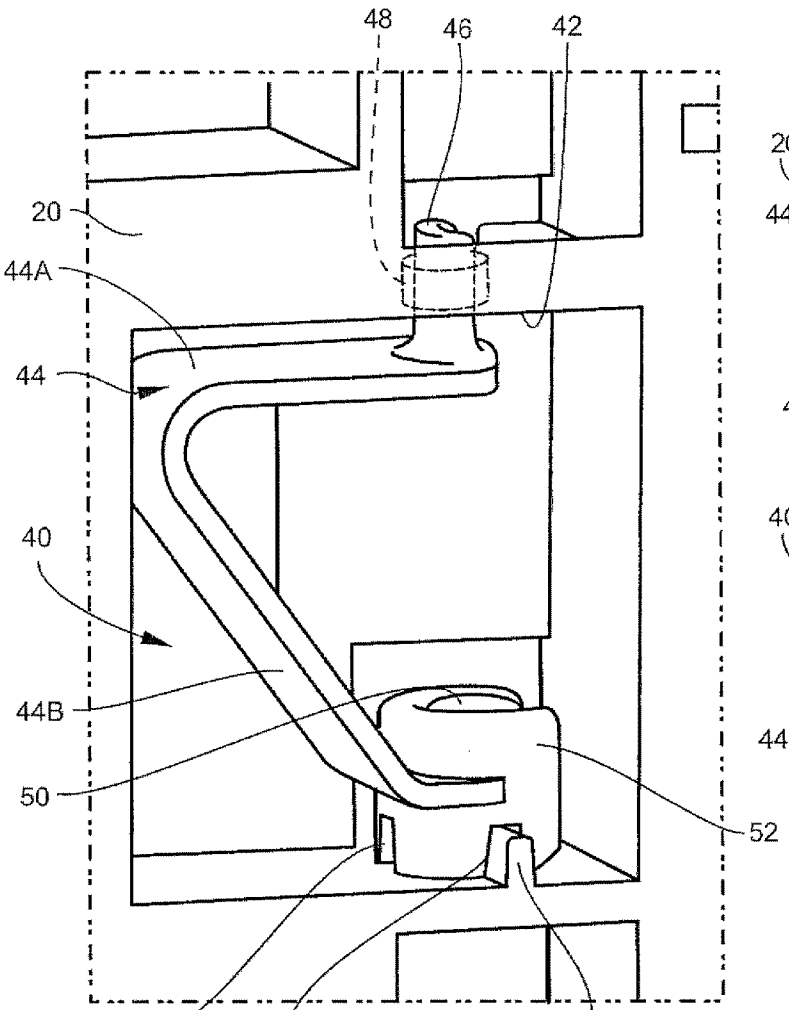
Figure 14:
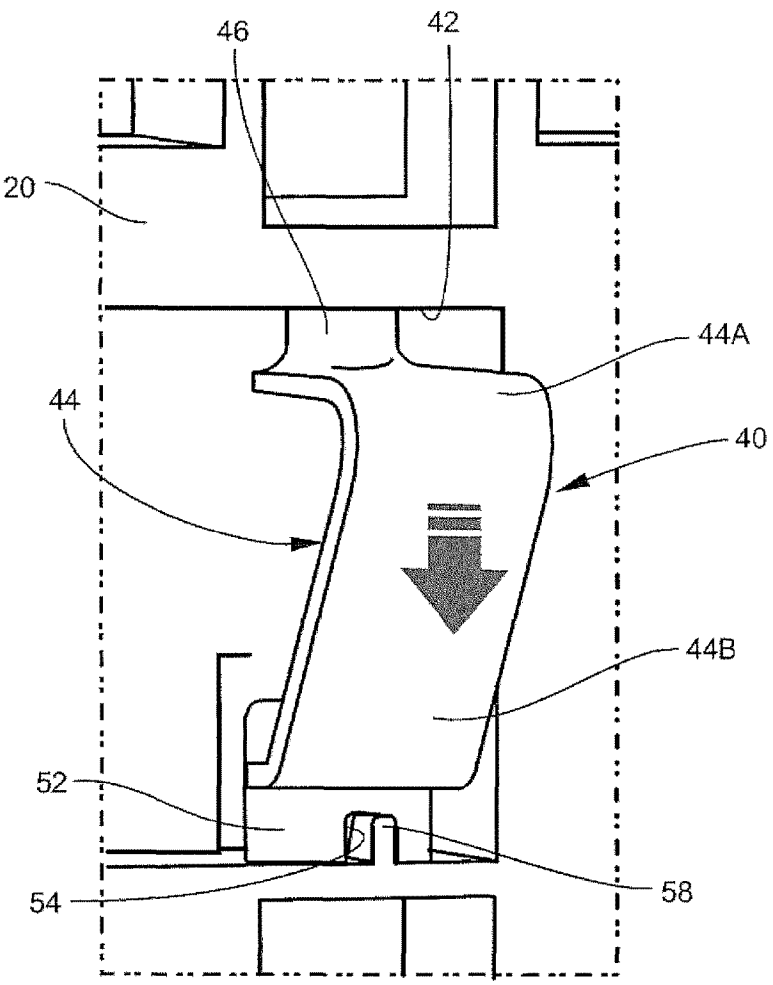
Figure 13:
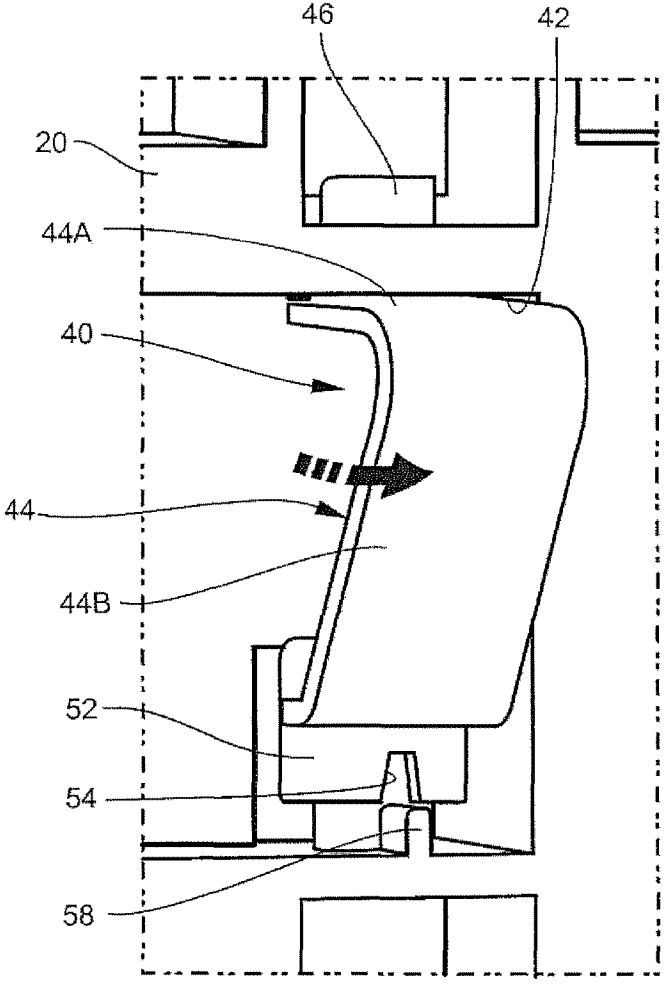

Further details and operation of the sidewall stop assembly 40 is shown in FIGS. 11-14. Each sidewall stop 44 is mounted in the top and bottom walls of the pocket 42 on the respective height-extending wall 20. The top connection for the sidewall stop 44 is a top post 46 positioned in a slot 48 in the top wall of the pocket 42. The bottom connection for the sidewall stop 44 utilizes a post and press fit. A mounting post 50 is integrally formed in a bottom wall of the pocket 42 and includes an indexing tab 58 formed in and extending upwardly from the bottom of the pocket 42. The sidewall stop 44 includes a bushing 52 carried on the lower end of the cantilever member 44B that includes indexing slots 54, 56 that fit over the indexing tab 58 of the mounting post 50. As shown in FIG. 11, when stowed, the sidewall stop 44 is positioned in the pocket 42 and the indexing tab 58 is positioned in the indexing slot 56, locking the sidewall stop 44 in the stowed position. As shown in FIG. 14, when deployed into its use position, the indexing tab 58 is positioned in the indexing slot 54, locking the sidewall stop 44 in the deployed position.

Figure 12:
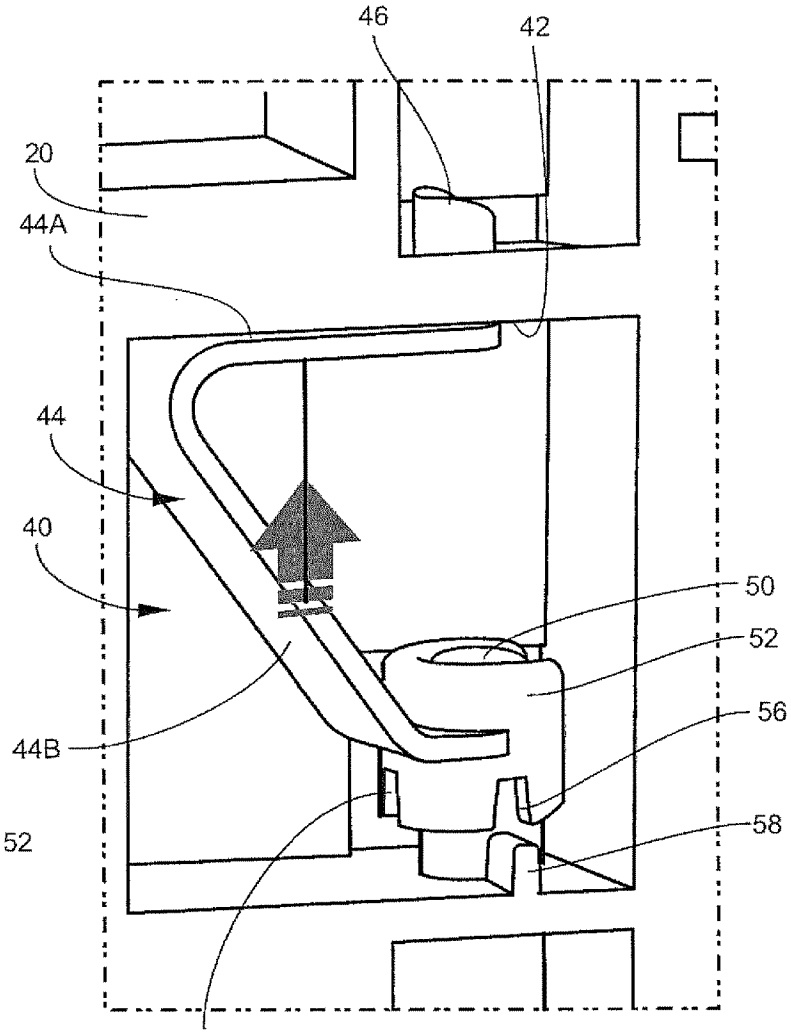
FIGS. 11-14 are sequential views showing movement of the sidewall stop from a stowed position to a deployed position.

Sequential operation is illustrated by noting that to deploy the sidewall stop 44 from its stowed position, FIG. 11, the sidewall stop 44 is raised so that the indexing tab 58 is withdrawn from the indexing slot 56, FIG. 12. In this raised position, the sidewall stop 44 is rotated sequentially 90 or 90+ degrees into the deployed position, FIG. 13. With the indexing slot 56 positioned over the indexing tab 58, the sidewall stop 44 is lowered, inserting the indexing tab 56 into the indexing slot 54 in the bushing 52, locking the sidewall stop 44 into the deployed position. To stow the deployed sidewall stop 44, the sequence described above is reversed.

A rotating sidewall stop adapted for supporting the folding walls of an extended height bulk box is described above. Various details of the invention maybe changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A height-extended bulk box, comprising:

(a) a quadrilateral base;

(b) four height-extending walls connected to respective sides of the base;

(c) four sidewalls pivotally mounted to respective ones of the height-extending walls and movable between a vertically erected use position and a collapsed configuration wherein the sidewalls are rotated inwardly into the area defined by quadrilateral base; and (d) at least one sidewall stop positioned on one of the height-extending walls and movable between a non-use stowed position and a deployed position that extends into the volume of the bulk box and arrests movement of a first of the sidewalls to be moved into a collapsed position past a position substantially parallel to the top deck of the base.

2. A height-extended bulk box according to claim 1, wherein the sidewall stop is mounted for rotation between the stowed position and the deployed position.

3. A height-extended bulk box according to claim 1, and including first and second sidewall stops positioned on first and second opposing height-extending walls.

4. A height-extended bulk box according to claim 3, wherein the opposed height-extending walls include respective pockets, the first and second sidewall stops are positioned in respective ones of the pockets and are mounted for rotation between a stowed position with the sidewall stops positioned in the respective pockets and a deployed position with the respective sidewall stops extending into the volume of the bulk box into the support position.

5. A height-extended bulk box according to claim 1, wherein the quadrilateral sides of the base are of equal length.

6. A height-extended bulk box, comprising:

(a) a quadrilateral base;

(b) four height-extending walls connected to respective sides of the base;

(c) four sidewalls pivotally mounted to respective ones of the height-extending walls and rotatable between a vertically erected use position and a collapsed configuration wherein the sidewalls are rotated inwardly into the area defined by a quadrilateral base; and (d) at least one side wall stop positioned in a pocket on one of the height-extending walls and movable between a non-use stowed position, and a deployed position that extends into the volume of the bulk box and arrests movement of a first of the sidewalls to be moved into a collapsed position past a position substantially parallel to the top deck of the base, wherein the sidewall stop includes a top wall support surface parallel to the top deck of the base and a cantilever member positioned to maintain the sidewall stop parallel to the top deck of the base.

7. A height-extended bulk box according to claim 6, wherein the pocket includes:

(a) a top wall and a bottom wall; and (b) a top post of the sidewall stop positioned for rotation in a slot in the top wall of the pocket and a bushing positioned on the sidewall stop for rotation on a bottom mounting post positioned on the bottom wall of the pocket.

8. A height-extended bulk box according to claim 7, and including an indexing tab formed in and extending upwardly from a base of the bottom mounting post and adapted to be received in a first slot in the bushing when the sidewall stop is in the stowed position and in a second, spaced-apart slot in the bushing when the sidewall stop is in the deployed position.

9. A height-extended bulk box according to claim 8, wherein the first and second slots are spaced 90 degrees apart.

10. A height-extended bulk box according to claim 7, wherein the sidewall stop includes a top wall support surface parallel to the top deck of the base and a cantilever member positioned to maintain the sidewall stop parallel to the top deck of the base.

11. A height-extended bulk box according to claim 10, wherein the top wall support and the cantilever member of the sidewall stop are integrally formed.

12. A height-extended bulk box according to claim 6, and including first and second sidewall stops positioned on first and second opposing height-extending walls and movable between a non-use stowed position and a deployed position that extends into the volume of the bulk box.

13. A height-extended bulk box according to claim 6, wherein the four sidewalls are pivotally mounted to respective ones of the height-extending walls by hinges that each include:

(a) an elongate hinge pocket having a vertical dimension formed in a top edge of a one of the height-extending walls; and (b) a bottom edge of the sidewall including a correspondingly-spaced hinge lug for being received into the hinge pocket for pivoting movement with movement of the sidewall, the hinge lug adapted to move vertically up and down within the hinge pocket as the sidewall is moved between upright and collapsed positions to permit the height-extending wall to achieve a coplanar position relative to the base in the collapsed condition.

* * * * *